US009257106B2

(12) United States Patent
Wei

(10) Patent No.: US 9,257,106 B2
(45) Date of Patent: Feb. 9, 2016

(54) DIGITAL BASS DRUM KICK

(71) Applicant: Al-Musics Technology Inc., New Taipei (TW)

(72) Inventor: Gwo-Hsiung Wei, New Taipei (TW)

(73) Assignee: AI-MUSICS TECHNOLOGY INC., New Taipei (TW)

( * ) Notice: Subject to any disclaimer, the term of this patent is extended or adjusted under 35 U.S.C. 154(b) by 100 days.

(21) Appl. No.: 14/174,834

(22) Filed: Feb. 6, 2014

(65) Prior Publication Data

US 2015/0221290 A1 Aug. 6, 2015

(51) Int. Cl.

| | |
|---|---|
| ***G10H 3/14*** | (2006.01) |
| ***G10D 13/00*** | (2006.01) |
| ***G10D 13/02*** | (2006.01) |

(52) U.S. Cl.

CPC ..... *G10D 13/006* (2013.01); *G10D 13/022* (2013.01); *G10H 3/143* (2013.01); *G10H 3/146* (2013.01)

(58) Field of Classification Search

CPC ..... G10D 13/006

USPC ..... 84/730

See application file for complete search history.

(56) References Cited

U.S. PATENT DOCUMENTS

| | | | | |
|---|---|---|---|---|
| 6,632,990 | B2 * | 10/2003 | Menzel et al. | 84/422.1 |
| 7,381,877 | B2 * | 6/2008 | Shigenaga | 84/422.1 |
| 8,178,769 | B2 * | 5/2012 | Steele | 84/421 |

* cited by examiner

*Primary Examiner* — Jianchun Qin
(74) *Attorney, Agent, or Firm* — Han IP Corporation

(57) ABSTRACT

Embodiments of a digital bass drum kick for a bass drum are provided. A digital bass drum kick includes an acoustic unit, a connection unit, and a support member. The acoustic unit has a first primary side and a second primary side. The first primary side is configured to receive impacts by a bass drum beater of a bass drum pedal. The second primary side is configured to conformably contact a drumhead of a bass drum, the acoustic unit configured to output a digital bass drum signal representative of a sound of the bass drum in response to the first primary side receiving an impact. The connection unit is configured to couple to a hoop of a bass drum. The support member is coupled between the acoustic unit and the connection unit, and is configured to elevate the acoustic unit a predefined distance from the connection unit.

17 Claims, 7 Drawing Sheets

100

(A) (B)

100

(A) (B)

DIGITAL BASS DRUM KICK

BACKGROUND

1. Technical Field

The present disclosure relates to the field of electronic musical instruments and, more particularly, to digital bass drum kicks.

2. Description of the Related Art

Bass drums are percussion instruments and vary in size. A bass drum is a large drum that produces a note of low definite or indefinite pitch, and is typically cylindrical with the diameter much greater than the height. There is normally a struck head, or drumhead, at both ends of the cylinder of the bass drum. The drumheads may be made of calf skin or plastic, and there is normally a means of adjusting the tension either by threaded taps or by strings.

A bass drum pedal operates much the same as a hi-hat control. Specifically, a footplate is connected to pull a chain, belt, or metal drive mechanism downward, bringing a beater or mallet forward into the drumhead. Typically, the beater head is usually made of either felt, wood, plastic, or rubber, and is attached to a rod-shaped metal shaft. The pedal and beater system are mounted in a metal frame and, like the hi-hat, a tension unit controls the amount of pressure needed to strike and the amount of recoil upon release.

SUMMARY

This section highlights a select number of embodiments as non-limiting illustrative examples of implementation of the inventive concept of the present disclosure. Accordingly, the scope of the claims in the present application is not limited to embodiments presented herein. Unless otherwise indicated herein, embodiments described in this section are not prior art to the claims in the present application and are not admitted to be prior art by inclusion in this section.

In one aspect, a digital bass drum kick may include an acoustic unit, a connection unit and a support member. The acoustic unit may have a first primary side and a second primary side. The first primary side may be configured to receive impacts by a bass drum beater of a bass drum pedal. The second primary side may be configured to conformably contact a drumhead of a bass drum. The acoustic unit may be configured to output a digital bass drum signal representative of a sound of the bass drum in response to the first primary side receiving an impact. The connection unit may be configured to couple to a hoop of the bass drum. The support member may be coupled between the acoustic unit and the connection unit, and may be configured to elevate the acoustic unit a predefined distance from the connection unit.

In some embodiments, the connection unit may be further configured to couple to the bass drum pedal such that the digital bass drum kick is coupled between the bass drum and the bass drum pedal.

In some embodiments, the connection unit may include a clamping mechanism configured to secure the digital bass drum kick to the hoop of the bass drum.

In some embodiments, the clamping mechanism of the connection unit may include a base, a hoop screw and a press block coupled to a distal end of the hoop screw. The hoop screw may be movably adjustable to generally move the press block in a first direction and a second direction opposite the first direction such that, with the hoop of the bass drum disposed between the press block and the base, the hoop of the bass drum is clamped by the press block and the base as the press block moves in the first direction and the hoop of the bass drum is not clamped as the press block moves in the second direction.

In some embodiments, the clamping mechanism may further include a screw and a bushing. The screw may be configured to secure the press block to the distal end of the hoop screw. The bushing may be placed between the press block and the hoop screw. The bushing may be configured to facilitate rotation of the press block with respect to a longitudinal axis of the hoop screw, wherein the screw traverses through the press block and the bushing.

In some embodiments, the base of the clamping mechanism may include a drum hoop protection piece, a rubber pad and a lower frame. The drum hoop protection piece may be configured to contact the hoop of the bass drum when the base is disposed under the hoop of the bass drum. The lower frame may be disposed between the drum hoop protection piece and the rubber pad.

In some embodiments, the connection unit may further include a drum hoop rubber piece that, together with the lower frame, forms a bass drum pedal interface configured to couple to the bass drum pedal such that the digital bass drum kick is coupled between the bass drum and the bass drum pedal.

In some embodiments, the acoustic unit may include a dampening member that defines the second primary side of the acoustic unit and is configured to conform to a surface of the drumhead of the bass drum when in contact with the drumhead.

In some embodiments, the dampening member may be configured to dampen vibrations of the digital bass drum kick and reduce acoustic resonance generated by the bass drum. The dampening member may be further configured to compensate for difference in depth of a drumhead of the bass drum from a rim of the hoop of the bass drum due to variation in design and size of the bass drum.

In some embodiments, the dampening member may include a foam pad.

In some embodiments, the acoustic unit may further include a percussion member, a vibration resonance member, a vibration damping member and an electronic sound generation unit. The percussion member may define the first primary side of the acoustic unit, and configured to generate vibrations when impacted by the bass drum beater. The vibration resonance member may be configured to resonate with vibrations. The vibration damping member, disposed between the percussion member and the vibration resonance member, may be configured to propagate the vibrations generated by the percussion member to the vibration resonance member. The electronic sound generation unit may be connected to the vibration resonance member and configured to sense the vibrations through the vibration resonance member to output the digital bass drum signal.

In some embodiments, the percussion member may include a hitting pad. The hitting pad may define the first primary side of the acoustic unit.

In some embodiments, the vibration resonance member may include a hub portion, a plurality of radial portions extending radially from the hub portion, and a rim portion circumscribing the radial portions.

In some embodiments, the vibration damping member may include a rubber foam.

In some embodiments, the electronic sound generation unit may include a sensor, a circuit and a substrate. The sensor may be configured to sense the vibrations and generate a sensing signal based on the vibrations. The circuit may be electrically coupled to the sensor and configured to receive the sensing signal to generate the digital bass drum signal.

The circuit may be coupled to the substrate. The substrate may be disposed between the vibration resonance member and the vibration damping member.

In some embodiments, the sensor may include a piezoelectric sensor.

In another aspect, a digital bass drum kick may include an acoustic unit, a connection unit and a support member. The acoustic unit may have a first primary side and a second primary side. The first primary side may be configured to receive impacts by a bass drum beater of a bass drum pedal. The second primary side may be configured to conformably contact a drumhead of a bass drum. The acoustic unit may be configured to output a digital bass drum signal representative of a sound of the bass drum in response to the first primary side receiving an impact. The connection unit may be configured to couple to a hoop of the bass drum and the bass drum pedal such that the digital bass drum kick is coupled between the bass drum and the bass drum pedal. The support member may be coupled between the acoustic unit and the connection unit, and may be configured to elevate the acoustic unit a predefined distance from the connection unit.

In some embodiments, the connection unit may include a clamping mechanism configured to secure the digital bass drum kick to the hoop of the bass drum. The clamping mechanism may include a base, a hoop screw and a press block. The base may include a drum hoop protection piece, a rubber pad and a lower frame. The drum hoop protection piece may be configured to contact the hoop of the bass drum when the base is disposed under the hoop of the bass drum. The lower frame may be disposed between the drum hoop protection piece and the rubber pad. The press block may be coupled to a distal end of the hoop screw. The hoop screw may be movably adjustable to generally move the press block in a first direction and a second direction opposite the first direction such that, with the hoop of the bass drum disposed between the press block and the base, the hoop of the bass drum is clamped by the press block and the base as the press block moves in the first direction and the hoop of the bass drum is not clamped as the press block moves in the second direction.

In some embodiments, the clamping mechanism may further include a screw and a bushing. The screw may be configured to secure the press block to the distal end of the hoop screw. The bushing may be placed between the press block and the hoop screw, and may be configured to facilitate rotation of the press block with respect to a longitudinal axis of the hoop screw, wherein the screw traverses through the press block and the bushing.

In some embodiments, the acoustic unit may include a dampening member that may define the second primary side of the acoustic unit and may be configured to conform to a surface of the drumhead of the bass drum when in contact with the drumhead. The dampening member may be configured to dampen vibrations of the digital bass drum kick and reduce acoustic resonance generated by the bass drum. The dampening member may be further configured to compensate for difference in depth of a drumhead of the bass drum from a rim of the hoop of the bass drum due to variation in design and size of the bass drum. The acoustic unit may further include a percussion member, a vibration resonance member, a vibration damping member and an electronic sound generation unit. The percussion member may define the first primary side of the acoustic unit, and may be configured to generate vibrations when impacted by the bass drum beater. The vibration resonance member may be configured to resonate with vibrations. The vibration damping member, disposed between the percussion member and the vibration resonance member, may be configured to propagate the vibrations generated by the percussion member to the vibration resonance member. The electronic sound generation unit may be connected to the vibration resonance member and configured to sense the vibrations through the vibration resonance member to output the digital bass drum signal.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

A digital bass drum kick in accordance with the present disclosure digitizes the generation of the sound of beating a bass drum. It is designed to suit and work with conventional bass drums without the need to move, alter or otherwise modify the bass drum. When a conventional bass drum is mounted with the digital bass drum kick of the present disclosure the conventional bass drum is converted into a digital bass drum. When in use, a base of the digital bass drum kick is wedged under the hoop of the bass drum with the weight of the bass drum on top. This design prevents damage to the bass drum hoop and helps secure the bass drum hoop in place.

When the digital bass drum kick is mounted in place, with its base wedged under the bass drum hoop, a foam pad of the digital bass drum kick comes in contact with the drumhead of the bass drum. The foam pad dampens the vibration of the digital bass drum kick and also reduces acoustic resonance generated by the bass drum. Additionally, the foam pad compensates difference in depth of the drumhead from a rim of the bass drum hoop due to variation in design and size of the bass drum.

The digital bass drum kick is designed with a fastener mechanism that fastens, mounts, affixes or otherwise couples the digital bass drum kick to the bass drum hoop to secure the digital bass drum kick to the bass drum hoop. The fastener mechanism includes a hoop screw. The hoop screw is tightened to press a press block of the fastener mechanism downward to clamp onto the bass drum hoop when the base of the digital bass drum kick is wedged under the bass drum hoop. The press block is configured such that it does not rotate but maintains a downward force to maximize the clamping force. This design protects the bass drum hoop from damage due to rotation.

The digital bass drum kick according to the present disclosure is designed so that it can be easily disassembled from the bass drum to allow the bass drum to be played in a conventional way.

EXEMPLARY EMBODIMENTS

Figure 1:
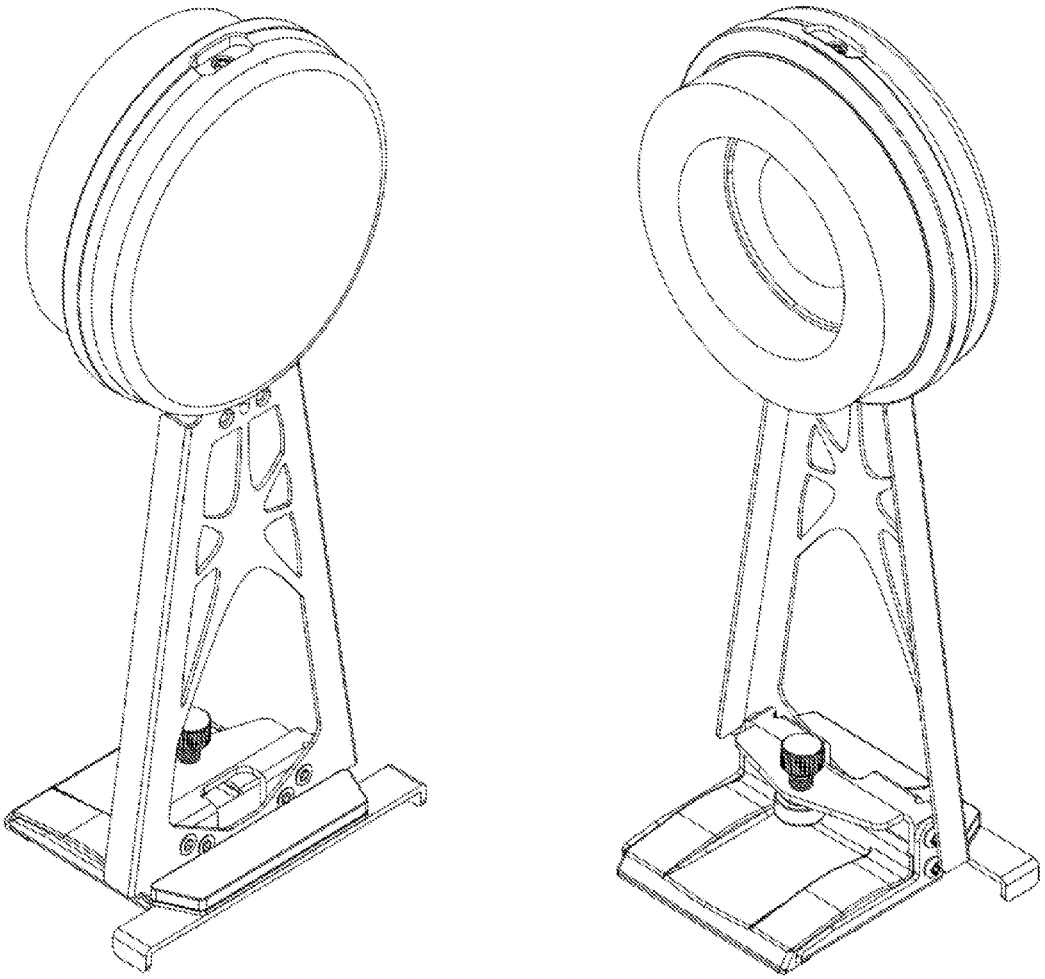
FIG. 1 shows front and rear perspective views of a digital bass drum kick in accordance with an embodiment of the present disclosure.
Figure 2:
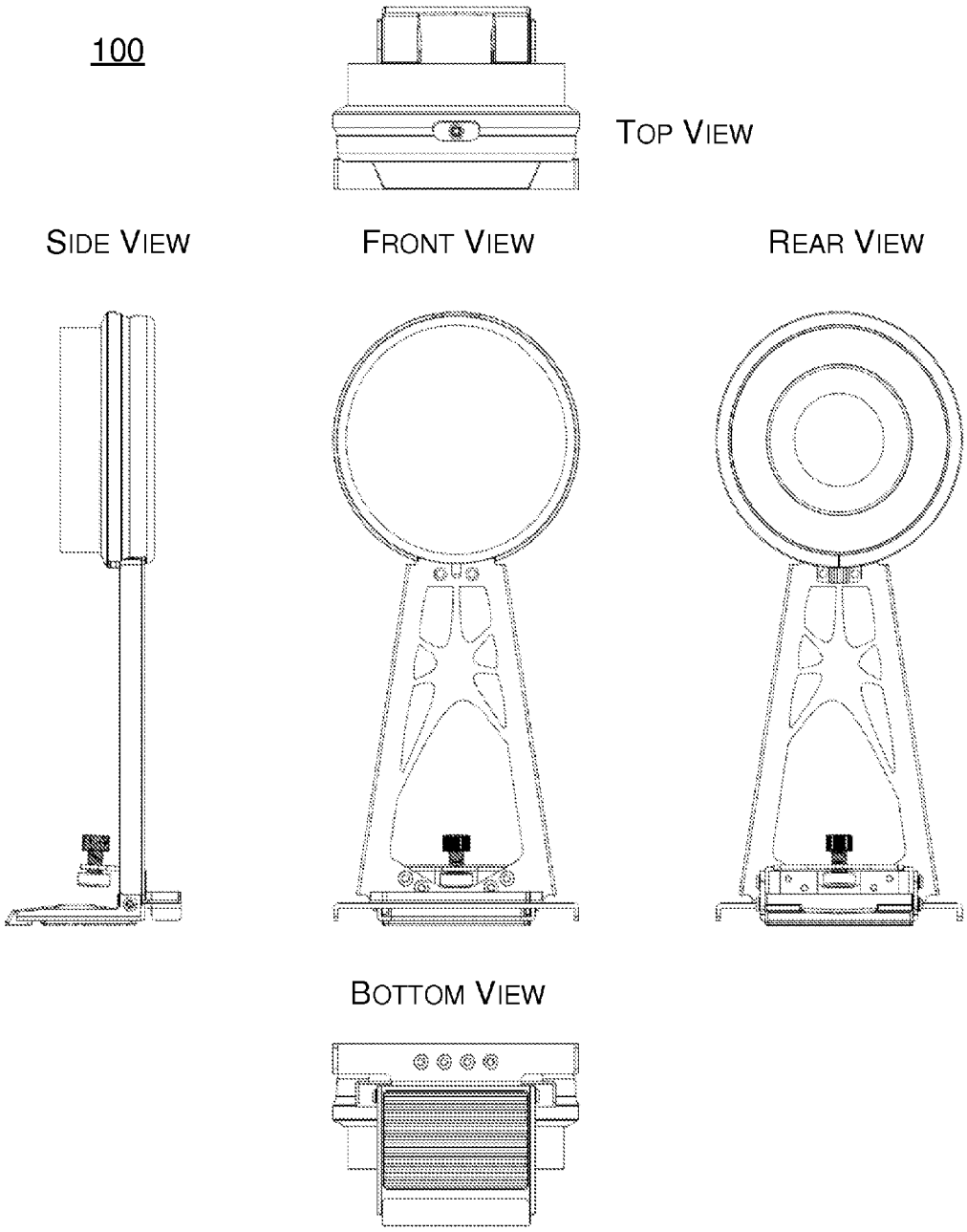
FIG. 2 shows various other views of the digital bass drum kick of FIG. 1.
Figure 3:
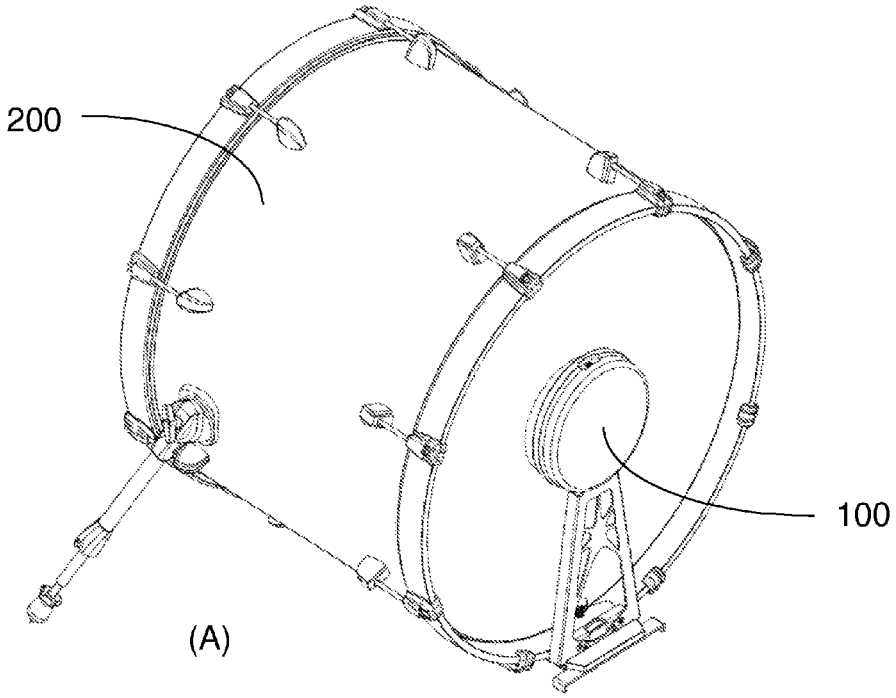
FIG. 3 shows various views of the digital bass drum kick of FIG. 1 attached to a bass drum in accordance with an embodiment of the present disclosure.
Figure 3:
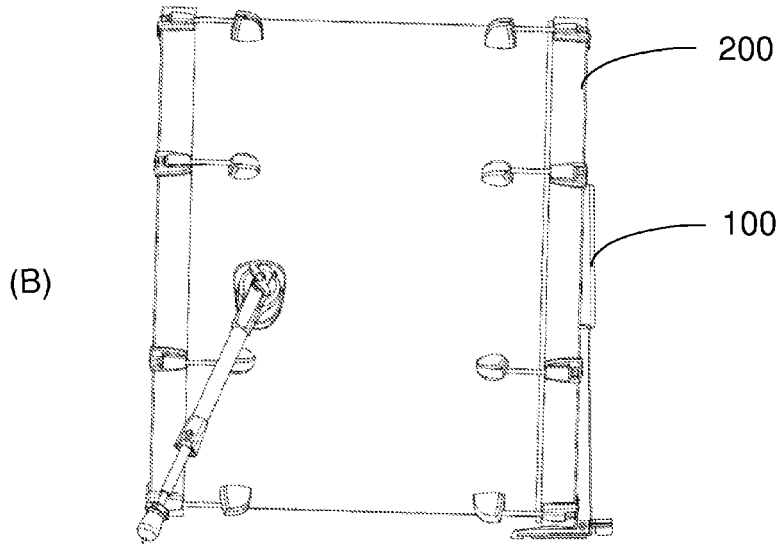
Figure 4:
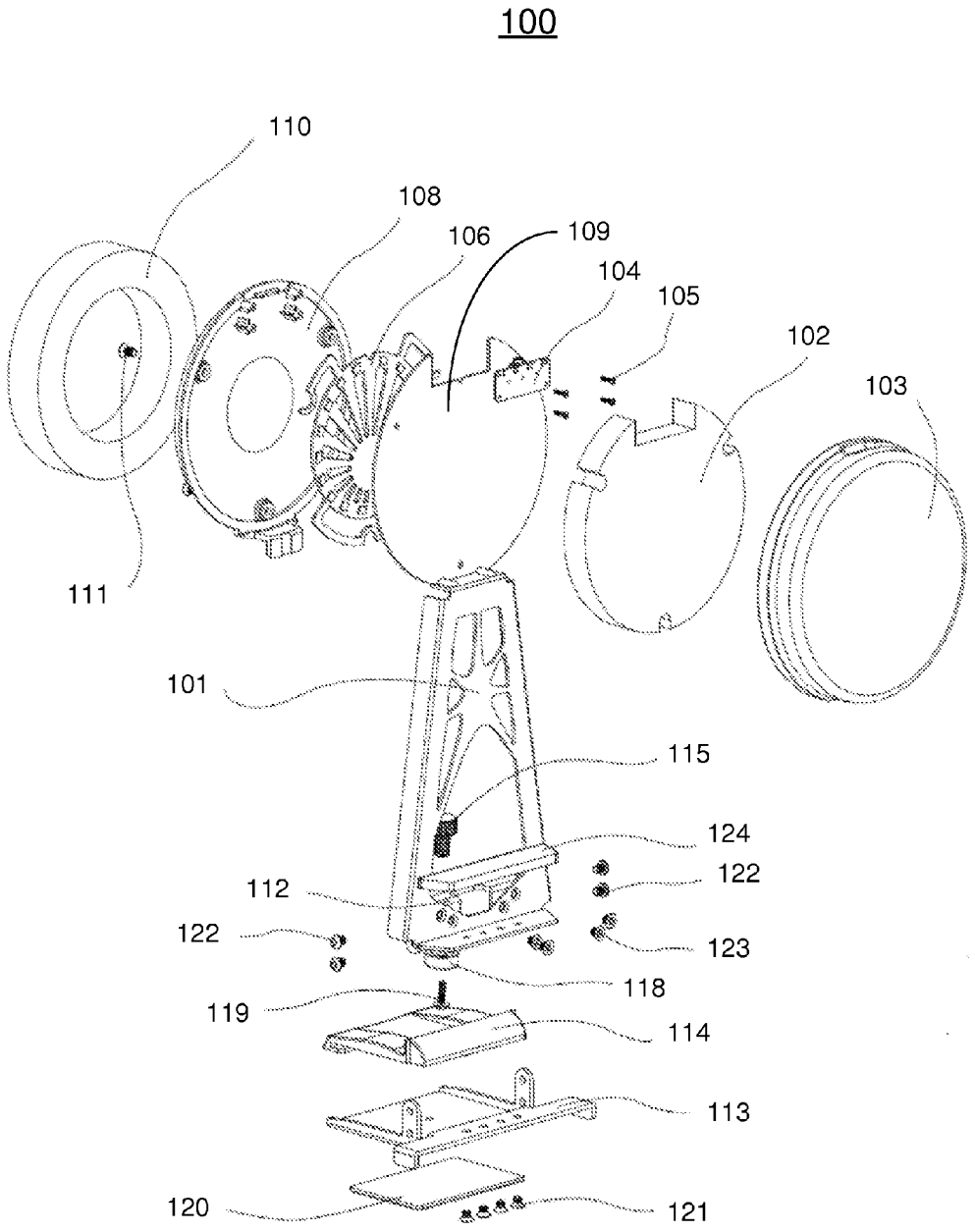
FIG. 4 is an exploded view of the digital bass drum kick of FIG. 1.
Figure 5:
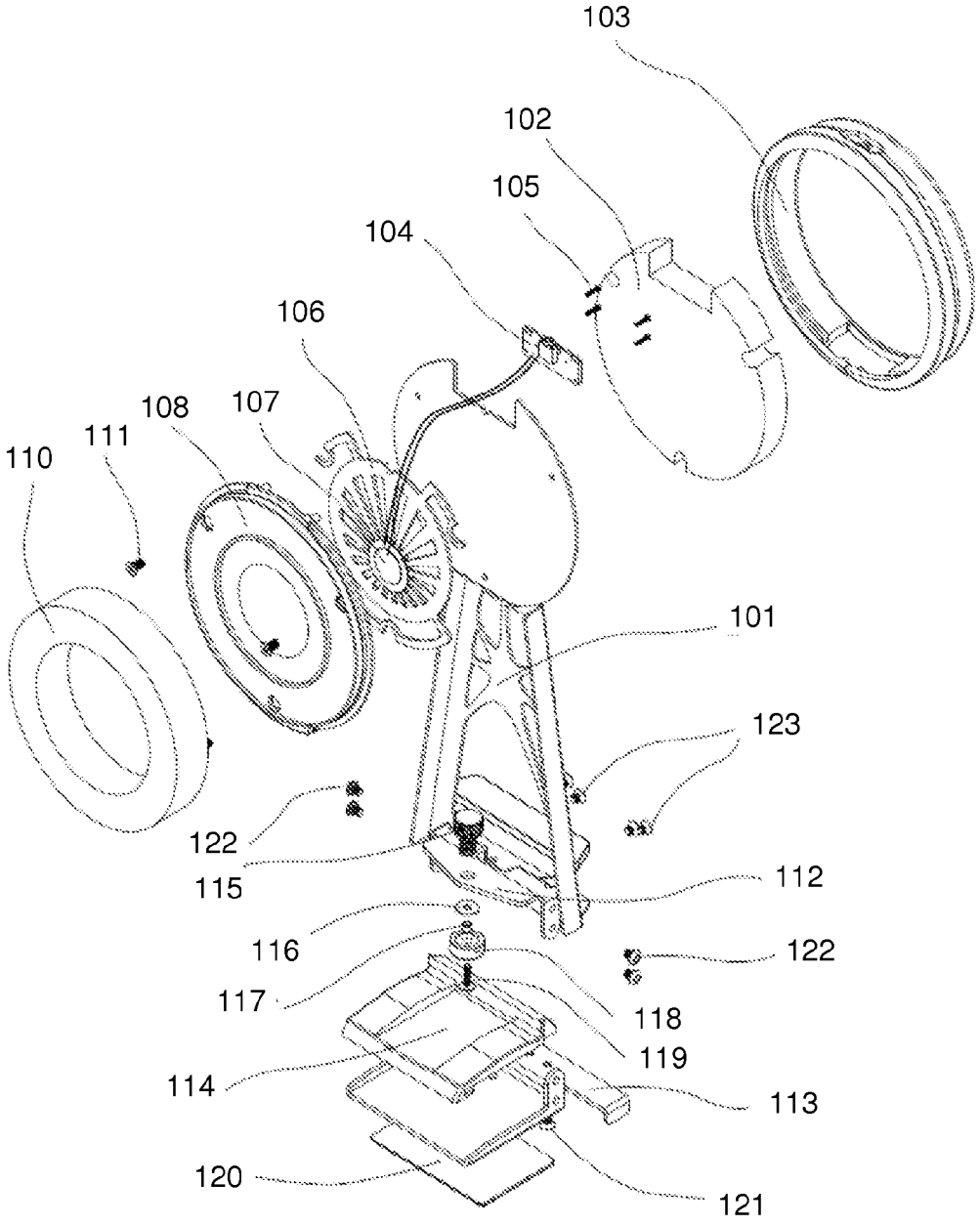
FIG. 5 is another exploded view of the digital bass drum kick of FIG. 1.
Figure 6:
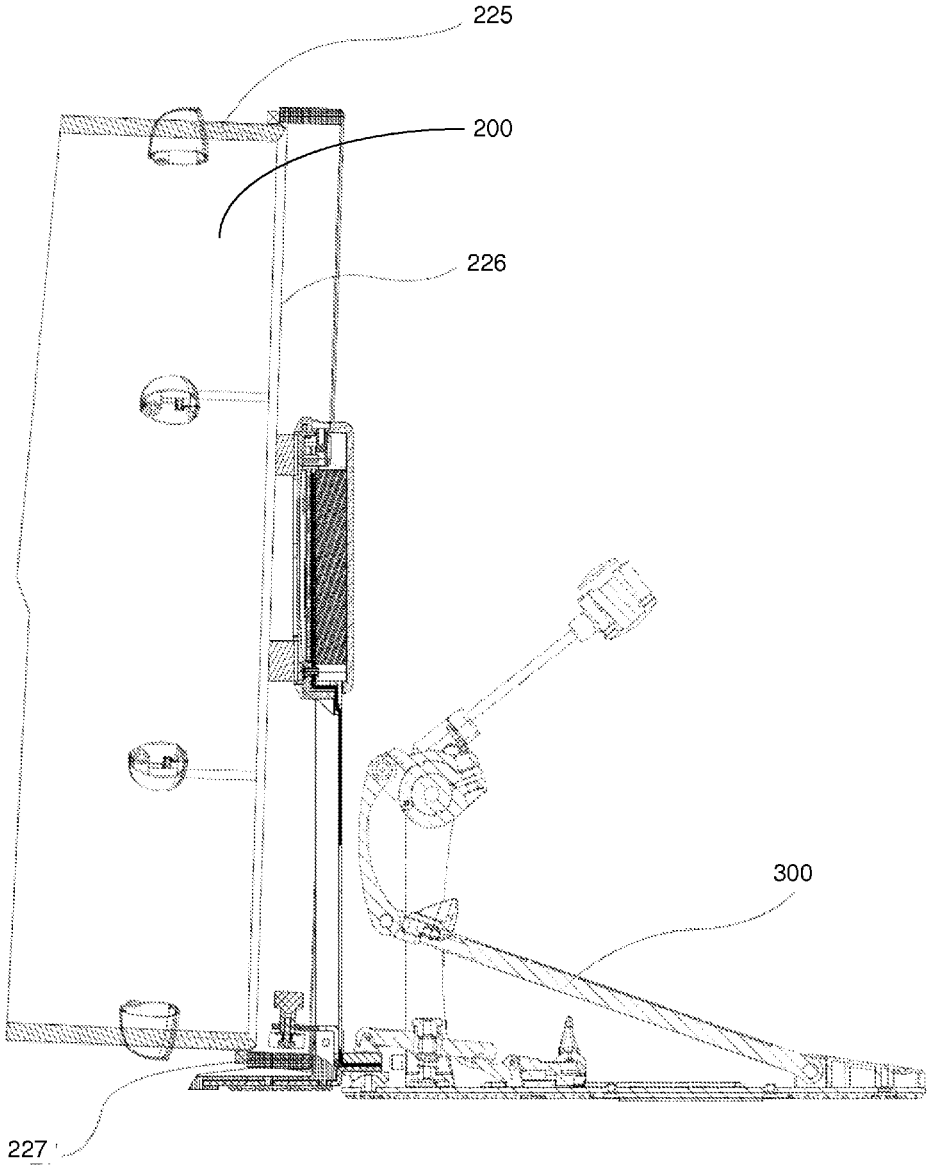
FIG. 6 is a side view of the digital bass drum kick of FIG. 1 assembled to a bass drum and a bass drum pedal in accordance with an embodiment of the present disclosure.
Figure 7:
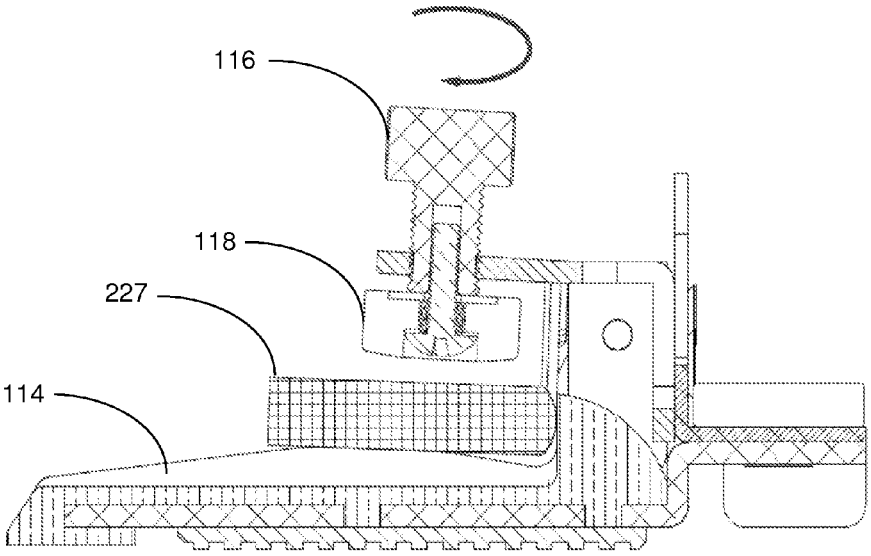
FIG. 7 is a schematic view of using a fastener mechanism to secure the digital bass drum kick to a bass drum hoop in accordance with an embodiment of the present disclosure.
Figure 8:
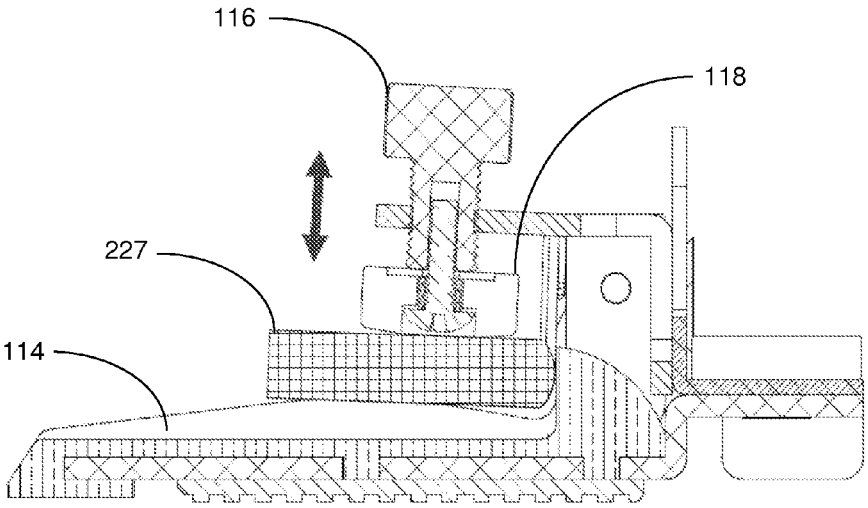
FIG. 8 is a schematic view of using the fastener mechanism of FIG. 7 to unsecure the digital bass drum kick to a bass drum hoop in accordance with an embodiment of the present disclosure.

FIGS. 1 and 2 illustrate various views of a digital bass drum kick 100 in accordance with an embodiment of the present disclosure. FIG. 3 shows various views of the digital bass drum kick 100 attached to a bass drum 200 in accordance with an embodiment of the present disclosure. FIGS. 4 and 5 illustrate various exploded views of the digital bass drum kick 100. FIG. 6 illustrates the digital bass drum kick 100 assembled to the bass drum 200 and a bass drum pedal 300 in accordance with an embodiment of the present disclosure. FIGS. 7 and 8 illustrate using a fastener mechanism to secure and unsecure the digital bass drum kick to a bass drum hoop in accordance with an embodiment of the present disclosure. The description below refers to FIGS. 1-8.

The digital bass drum kick 100 includes an acoustic unit, a connection unit and a support member 101. The acoustic unit has a first primary side and a second primary side. The first primary side is configured to receive impacts by a bass drum beater of the bass drum pedal 300. The second primary side is configured to conformably contact a drumhead 226 of the bass drum 200. The acoustic unit is configured to output a digital bass drum signal representative of a sound of the bass drum 200 in response to the first primary side receiving an impact. The connection unit is configured to couple to a hoop 227 of the bass drum 200. The support member 101 is coupled between the acoustic unit and the connection unit, and is configured to elevate the acoustic unit a predefined distance from the connection unit.

In some embodiments, the connection unit is further configured to couple to the bass drum pedal 300 such that the digital bass drum kick 100 is coupled between the bass drum 200 and the bass drum pedal 300, e.g., as shown in FIG. 6.

In some embodiments, the connection unit includes a clamping mechanism configured to secure the digital bass drum kick 100 to the hoop 227 of the bass drum 200, e.g., as shown in FIGS. 3 and 6.

In some embodiments, the clamping mechanism of the connection unit includes a base, a hoop screw 115 and a press block 118 coupled to a distal end of the hoop screw 115. Referring to FIGS. 7 and 8, the hoop screw 115 is movably adjustable to generally move the press block 118 in a first direction (e.g., downward) and a second direction (e.g., upward) opposite the first direction such that, with the hoop 227 of the bass drum 200 disposed between the press block 118 and the base, the hoop 227 of the bass drum 200 is clamped by the press block 118 and the base as the press block 118 moves in the first direction. Additionally, the hoop 227 of the bass drum 200 is not clamped as the press block 118 moves in the second direction.

In some embodiments, the clamping mechanism further includes a screw 119, a bushing 117 and a washer 116. The screw 119 is configured to screw or otherwise secure the press block 118 to the distal end of the hoop screw 115. The bushing 117 is placed between the press block 118 and the hoop screw 115. The bushing 117 is configured to facilitate rotation of the press block 118 with respect to a longitudinal axis of the hoop screw 116. The screw 119 traverses through the press block 118 and the bushing 117. The bushing 117 may be, for example, a steel bushing.

In some embodiments, the base of the clamping mechanism includes a drum hoop protection piece 114, a rubber pad 120 and a lower frame 113. The drum hoop protection piece 114 is configured to contact the hoop 227 of the bass drum 200 when the base is disposed under the hoop 227 of the bass drum 200. The lower frame 113 is disposed between the drum hoop protection piece 114 and the rubber pad 120. As shown in FIGS. 4 and 5, the lower frame 113 is screwed to the support member 101 by one or more screws 121 and one or more screws 123.

In some embodiments, the connection unit further includes a drum hoop rubber piece 124 that, together with the lower frame 113, forms a bass drum pedal interface configured to couple to the bass drum pedal 300 such that the digital bass drum kick 100 is coupled between the bass drum 200 and the bass drum pedal 300. The connection unit also includes an upper frame 112 through which the hoop screw 115 traverses. The upper frame 112 is screwed or otherwise secured to the support member 101 by one or more screws 122.

In some embodiments, the acoustic unit includes a dampening member 110 that defines the second primary side of the acoustic unit and is configured to conform to a surface of the drumhead 226 of the bass drum 200 when in contact with the drumhead 226.

In some embodiments, the dampening member 110 is configured to dampen vibrations of the digital bass drum kick 100 and reduce acoustic resonance generated by the bass drum 200. The dampening member 110 is further configured to compensate for difference in depth of a drumhead 226 of the bass drum 200 from a rim of the hoop 227 of the bass drum 200 due to variation in design and size of the drum shell 225 of the bass drum 200.

In some embodiments, the dampening member 110 is a foam pad.

In some embodiments, the acoustic unit further includes a percussion member 103, a vibration resonance member 106, a vibration damping member 102 and an electronic sound generation unit. The percussion member 103 defines the first primary side of the acoustic unit, and is configured to generate vibrations when impacted by the bass drum beater of the bass drum pedal 300. The vibration resonance member 106 is configured to resonate with vibrations. The vibration damping member 102, disposed between the percussion member 103 and the vibration resonance member 106, is configured to propagate the vibrations generated by the percussion member 103 to the vibration resonance member 106. The electronic sound generation unit is connected to the vibration resonance member 106 and configured to sense the vibrations through the vibration resonance member 106 to output the digital bass drum signal.

In some embodiments, the percussion member 103 includes a hitting pad. The hitting pad defines the first primary side of the acoustic unit.

In some embodiments, the vibration resonance member 106 includes a hub portion, a plurality of radial portions extending radially from the hub portion, and a rim portion circumscribing the radial portions.

In some embodiments, the vibration damping member 102 includes a rubber foam.

In some embodiments, the electronic sound generation unit includes a sensor 107 and a circuit 104. The sensor 107 is configured to sense the vibrations and generate a sensing signal based on the vibrations. The circuit 104 is electrically coupled to the sensor 107 and is configured to receive the sensing signal to generate the digital bass drum signal. The circuit 104 is coupled to an extension portion 109 of the support member 101. The extension portion 109 is disposed between the vibration resonance member 106 and the vibration damping member 102.

In some embodiments, the sensor 107 includes a piezoelectric sensor.

The acoustic unit may also include a cover 108 that is secured to the extension portion 109 of the support member 101 by one or more screws 111. The cover 108 is disposed between the dampening member 110 and the vibration resonance member 106. The circuit 104 may be secured to the extension portion 109 of the support member 101 by one or more screws 105.

Additional and Alternative Implementation Notes

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

In the above description of exemplary implementations, for purposes of explanation, specific numbers, materials configurations, and other details are set forth in order to better explain the invention, as claimed. However, it will be apparent to one skilled in the art that the claimed invention may be practiced using different details than the exemplary ones described herein. In other instances, well-known features are omitted or simplified to clarify the description of the exemplary implementations.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. A digital bass drum kick, comprising:

an acoustic unit having a first primary side and a second primary side, the first primary side configured to receive impacts by a bass drum beater of a bass drum pedal, the second primary side configured to conformably contact a drumhead of a bass drum, the acoustic unit configured to output a digital bass drum signal representative of a sound of the bass drum in response to the first primary side receiving an impact;

a connection unit configured to couple to a hoop of the bass drum; and a support member coupled between the acoustic unit and the connection unit, the support member configured to elevate the acoustic unit a predefined distance from the connection unit, wherein the acoustic unit comprises a dampening member that defines the second primary side of the acoustic unit and is configured to conform to a surface of the drumhead of the bass drum when in contact with the drumhead, and wherein the acoustic unit further comprises:

a percussion member that defines the first primary side of the acoustic unit, the percussion member configured to generate vibrations when impacted by the bass drum beater;

a vibration resonance member configured to resonate with vibrations;

a vibration damping member, disposed between the percussion member and the vibration resonance member, and configured to propagate the vibrations generated by the percussion member to the vibration resonance member; and an electronic sound generation unit connected to the vibration resonance member and configured to sense the vibrations through the vibration resonance member to output the digital bass drum signal.

2. The digital bass drum kick of claim 1, wherein the connection unit is further configured to couple to the bass drum pedal such that the digital bass drum kick is coupled between the bass drum and the bass drum pedal.

3. The digital bass drum kick of claim 1, wherein the connection unit comprises a clamping mechanism configured to secure the digital bass drum kick to the hoop of the bass drum.

4. The digital bass drum kick of claim 3, wherein the clamping mechanism of the connection unit comprises:

a base;

a hoop screw; and a press block coupled to a distal end of the hoop screw, wherein the hoop screw is movably adjustable to generally move the press block in a first direction and a second direction opposite the first direction such that, with the hoop of the bass drum disposed between the press block and the base, the hoop of the bass drum is clamped by the press block and the base as the press block moves in the first direction and the hoop of the bass drum is not clamped as the press block moves in the second direction.

5. The digital bass drum kick of claim 4, wherein the clamping mechanism further comprises:

a screw configured to secure the press block to the distal end of the hoop screw; and a bushing placed between the press block and the hoop screw, the bushing configured to facilitate rotation of the press block with respect to a longitudinal axis of the hoop screw, wherein the screw traverses through the press block and the bushing.

6. The digital bass drum kick of claim 4, wherein the base of the clamping mechanism comprises:

a drum hoop protection piece configured to contact the hoop of the bass drum when the base is disposed under the hoop of the bass drum;

a rubber pad; and a lower frame disposed between the drum hoop protection piece and the rubber pad.

7. The digital bass drum kick of claim 6, wherein the connection unit further comprises a drum hoop rubber piece that, together with the lower frame, forms a bass drum pedal interface configured to couple to the bass drum pedal such that the digital bass drum kick is coupled between the bass drum and the bass drum pedal.

8. The digital bass drum kick of claim 1, wherein the dampening member is configured to dampen vibrations of the digital bass drum kick and reduce acoustic resonance generated by the bass drum, and wherein the dampening member is further configured to compensate for difference in depth of a drumhead of the bass drum from a rim of the hoop of the bass drum due to variation in design and size of the bass drum.

9. The digital bass drum kick of claim 1, wherein the dampening member comprises a foam pad.

10. The digital bass drum kick of claim 1, wherein the percussion member comprises a hitting pad, wherein the hitting pad defines the first primary side of the acoustic unit.

11. The digital bass drum kick of claim 1, wherein the vibration resonance member comprises a hub portion, a plurality of radial portions extending radially from the hub portion, and a rim portion circumscribing the radial portions.

12. The digital bass drum kick of claim 1, wherein the vibration damping member comprises a rubber foam.

13. The digital bass drum kick of claim 1, wherein the electronic sound generation unit comprises:

a sensor configured to sense the vibrations and generate a sensing signal based on the vibrations;

a circuit electrically coupled to the sensor and configured to receive the sensing signal to generate the digital bass drum signal; and a substrate to which the circuit is coupled, wherein the substrate is disposed between the vibration resonance member and the vibration damping member.

14. The digital bass drum kick of claim 13, wherein the sensor comprises a piezoelectric sensor.

15. A digital bass drum kick, comprising:

an acoustic unit having a first primary side and a second primary side, the first primary side configured to receive impacts by a bass drum beater of a bass drum pedal, the second primary side configured to conformably contact a drumhead of a bass drum, the acoustic unit configured to output a digital bass drum signal representative of a sound of the bass drum in response to the first primary side receiving an impact;

a connection unit configured to couple to a hoop of the bass drum and the bass drum pedal such that the digital bass drum kick is coupled between the bass drum and the bass drum pedal; and a support member coupled between the acoustic unit and the connection unit, the support member configured to elevate the acoustic unit a predefined distance from the connection unit, wherein the acoustic unit comprises a dampening member that defines the second primary side of the acoustic unit and is configured to conform to a surface of the drumhead of the bass drum when in contact with the drumhead, wherein the dampening member is configured to dampen vibrations of the digital bass drum kick and reduce acoustic resonance generated by the bass drum, wherein the dampening member is further configured to compensate for difference in depth of a drumhead of the bass drum from a rim of the hoop of the bass drum due to variation in design and size of the bass drum, and wherein the acoustic unit further comprises:

a percussion member that defines the first primary side of the acoustic unit, the percussion member configured to generate vibrations when impacted by the bass drum beater;

a vibration resonance member configured to resonate with vibrations;

a vibration damping member, disposed between the percussion member and the vibration resonance member, and configured to propagate the vibrations generated by the percussion member to the vibration resonance member; and an electronic sound generation unit connected to the vibration resonance member and configured to sense the vibrations through the vibration resonance member to output the digital bass drum signal.

16. The digital bass drum kick of claim 15, wherein the connection unit comprises a clamping mechanism configured to secure the digital bass drum kick to the hoop of the bass drum, wherein the clamping mechanism comprises:

a base, comprising:

a drum hoop protection piece configured to contact the hoop of the bass drum when the base is disposed under the hoop of the bass drum;

a rubber pad; and a lower frame disposed between the drum hoop protection piece and the rubber pad;

a hoop screw; and a press block coupled to a distal end of the hoop screw, wherein the hoop screw is movably adjustable to generally move the press block in a first direction and a second direction opposite the first direction such that, with the hoop of the bass drum disposed between the press block and the base, the hoop of the bass drum is clamped by the press block and the base as the press block moves in the first direction and the hoop of the bass drum is not clamped as the press block moves in the second direction.

17. The digital bass drum kick of claim 16, wherein the clamping mechanism further comprises:

a screw configured to secure the press block to the distal end of the hoop screw; and a bushing placed between the press block and the hoop screw, the bushing configured to facilitate rotation of the press block with respect to a longitudinal axis of the hoop screw, wherein the screw traverses through the press block and the bushing.

* * * * *